US011988485B2

(12) United States Patent
Caffey et al.

(10) Patent No.: US 11,988,485 B2
(45) Date of Patent: May 21, 2024

(54) FIREARM ACCESSORY MOUNT, METHOD OF FORMING THE SAME, AND METHOD OF USING THE SAME

(71) Applicant: Groovlok LLC, Gilmer, TX (US)

(72) Inventors: Clint Lyndell Caffey, Gilmer, TX (US); Christopher Glenn Caffey, Gilmer, TX (US)

(73) Assignee: Groovlok LLC, Gilmer, TX (US)

( * ) Notice: Subject to any disclaimer, the term of this patent is extended or adjusted under 35 U.S.C. 154(b) by 0 days.

(21) Appl. No.: 17/873,986

(22) Filed: Jul. 26, 2022

(65) Prior Publication Data

US 2023/0027511 A1 Jan. 26, 2023

Related U.S. Application Data

(60) Provisional application No. 63/225,811, filed on Jul. 26, 2021.

(51) Int. Cl.
*F41G 11/00* (2006.01)
*F41C 27/00* (2006.01)

(52) U.S. Cl.
CPC ..... *F41G 11/003* (2013.01); *F41C 27/00* (2013.01)

(58) Field of Classification Search
CPC ..... F41G 11/003; F41C 27/00
See application file for complete search history.

(56) References Cited

U.S. PATENT DOCUMENTS 2,615,664 A * 10/1952 Reeves ..... F16M 11/041 248/187.1
4,021,954 A * 5/1977 Crawford ..... F41G 11/003 42/127
4,959,908 A * 10/1990 Weyrauch ..... F41G 11/003 42/127
5,669,173 A * 9/1997 Rodney, Jr. ..... F41G 11/003 42/127
6,371,424 B1 * 4/2002 Shaw ..... F41G 1/54 248/222.12
6,678,988 B1 * 1/2004 Poff, Jr. ..... F41G 11/003 42/147
7,908,784 B2 * 3/2011 Kim ..... F41G 11/003 42/146
8,020,821 B2 * 9/2011 Chen ..... F16M 13/02 248/221.11
8,104,218 B2 * 1/2012 McCann ..... F41G 1/033 42/144

(Continued)

*Primary Examiner* — Michelle Clement
(74) *Attorney, Agent, or Firm* — Slater Matsil, LLP

(57) ABSTRACT

An embodiment firearm accessory mount includes: a main base including: a firearm groove at a bottom of the main base; and a mating groove at a top of the main base, the mating groove extending from a front of the main base to a rear of the main base, a first width of the mating groove decreasing continually in a first direction extending from the front of the main base to the rear of the main base; and an accessory mount including: an accessory groove at a top of the accessory mount; and a mating slide at a bottom of the accessory mount, the mating slide extending from a front of the accessory mount to a rear of the accessory mount, a second width of the mating slide decreasing continually in a second direction extending from the front of the accessory mount to the rear of the accessory mount.

20 Claims, 9 Drawing Sheets

(56) References Cited

U.S. PATENT DOCUMENTS

| | | | | |
|---|---|---|---|---|
| 8,109,032 | B2 * | 2/2012 | Faifer | G03B 17/563 42/114 |
| 8,151,508 | B1 * | 4/2012 | Moore | F41G 11/003 42/124 |
| 8,656,624 | B2 * | 2/2014 | Holmberg | F41B 5/1492 42/124 |
| 8,739,451 | B2 * | 6/2014 | Nelson | F41A 9/63 224/931 |
| 9,157,698 | B2 * | 10/2015 | Cosentino | F41G 11/006 |
| 9,353,936 | B2 * | 5/2016 | Jigamian | F16B 39/10 |
| 9,631,897 | B1 * | 4/2017 | Irwin | F41G 11/003 |
| 9,690,090 | B2 * | 6/2017 | Russ | F41G 1/345 |
| 10,222,172 | B2 * | 3/2019 | Melville | F41C 33/041 |
| 10,408,570 | B2 * | 9/2019 | Toole | F41G 11/001 |
| 10,801,814 | B2 * | 10/2020 | Ma | F41G 11/003 |
| 10,859,344 | B1 * | 12/2020 | Marfione | F41G 1/02 |
| 10,890,406 | B1 * | 1/2021 | Whang | F41C 33/001 |
| 11,029,131 | B2 * | 6/2021 | Cahill | F41G 11/003 |
| 11,047,644 | B2 * | 6/2021 | Shearer | F41C 33/0263 |
| 11,125,536 | B2 * | 9/2021 | Kowalczyk, Jr. | F41G 11/003 |
| 11,733,003 | B2 * | 8/2023 | Kowalczyk, Jr. | F41G 1/35 42/90 |
| 2007/0025101 | A1 * | 2/2007 | Lawless | F41G 1/35 362/396 |
| 2018/0335599 | A1 * | 11/2018 | McCreight | F41G 11/003 |
| 2019/0285386 | A1 * | 9/2019 | Burt | F41G 11/006 |
| 2021/0389101 | A1 * | 12/2021 | Hughes | F41G 11/004 |
| 2022/0032008 | A1 * | 2/2022 | Khoo | A61M 25/0113 |
| 2023/0026346 | A1 * | 1/2023 | Risley | F41C 23/16 |
| 2023/0112612 | A1 * | 4/2023 | Lee | F41G 11/001 42/125 |
| 2023/0221097 | A1 * | 7/2023 | Melville | F41G 11/003 42/90 |

* cited by examiner

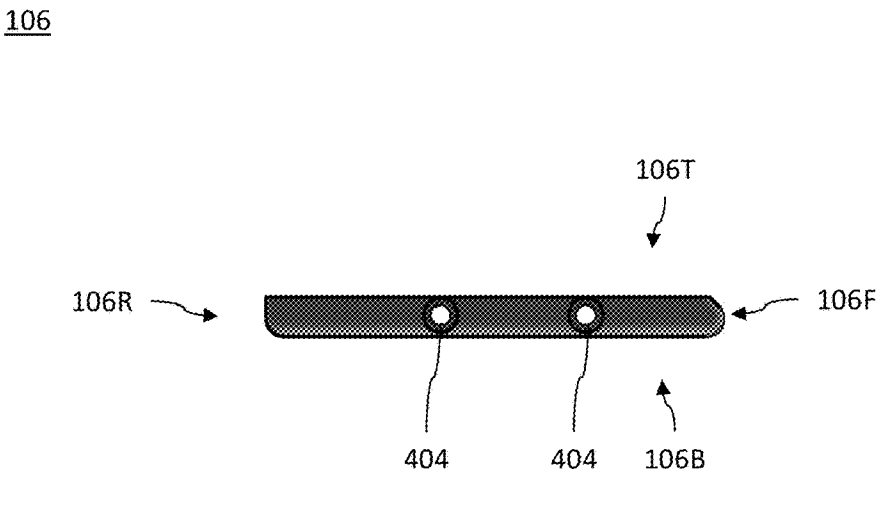
Figure 4A
Figure 4B
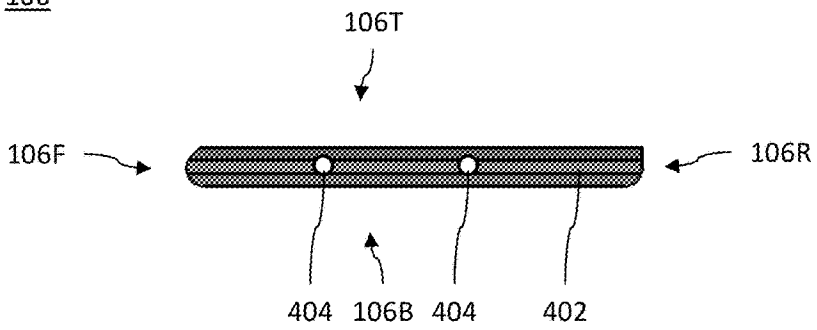
Figure 4C
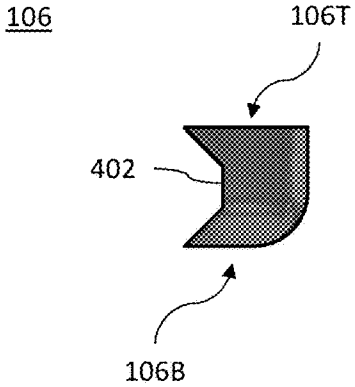
Figure 4D

FIREARM ACCESSORY MOUNT, METHOD OF FORMING THE SAME, AND METHOD OF USING THE SAME

CROSS-REFERENCE TO RELATED APPLICATIONS

This application claims the benefit of U.S. Provisional Application No. 63/225,811, filed on Jul. 26, 2021, which application is hereby incorporated herein by reference.

BACKGROUND

Scopes, flashlights, ranging devices, and other types of accessories may be attached to a firearm. Mounting systems may be utilized to mount an accessory to a firearm. As the technology of firearm accessories has progressed, there has been an increasing demand for more sophisticated accessory mounting systems.

SUMMARY

In an embodiment, a firearm accessory mount includes: a main base including: a firearm groove at a bottom of the main base; and a mating groove at a top of the main base, the mating groove extending from a front of the main base to a rear of the main base, a first width of the mating groove decreasing continually in a first direction extending from the front of the main base to the rear of the main base; and an accessory mount including: an accessory groove at a top of the accessory mount; and a mating slide at a bottom of the accessory mount, the mating slide extending from a front of the accessory mount to a rear of the accessory mount, a second width of the mating slide decreasing continually in a second direction extending from the front of the accessory mount to the rear of the accessory mount. In some embodiments of the firearm accessory mount, the main base further includes a first pin hole, the accessory mount further includes a second pin hole, and the first pin hole is aligned with the second pin hole when the mating slide is fitted in the mating groove. In some embodiments, the firearm accessory mount further includes: a release pin in the first pin hole. In some embodiments of the firearm accessory mount, the accessory mount further includes accessory bolt holes extend from the top of the accessory mount to the bottom of the accessory mount. In some embodiments of the firearm accessory mount, a lower portion of the mating groove has substantially parallel sidewalls and an upper portion of the mating groove has flared sidewalls. In some embodiments of the firearm accessory mount, the upper portion of the mating groove is wider than the lower portion of the mating groove. In some embodiments of the firearm accessory mount, a lower portion of the mating slide has substantially parallel sidewalls and an upper portion of the mating slide has flared sidewalls. In some embodiments of the firearm accessory mount, the upper portion of the mating slide is wider than the lower portion of the mating slide. In some embodiments, the firearm accessory mount further includes: a backing plate, where the main base further includes a backing plate recess for the backing plate at the rear of the main base. In some embodiments, the firearm accessory mount further includes: backing plate bolts securing the backing plate to the main base. In some embodiments, the firearm accessory mount further includes: a detachable rail, where the main base further includes a rail groove for the detachable rail at the bottom of the main base. In some embodiments, the firearm accessory mount further includes: cross bolts securing the detachable rail to the main base.

In an embodiment, a method includes: forming a main base and an accessory mount for a firearm accessory mount, the main base including a mating groove having a first wedge shape, the accessory mount including a mating slide having a second wedge shape; forming protective coatings on the main base and the accessory mount; and assembling the firearm accessory mount by sliding the mating slide of the accessory mount into the mating groove of the main base until the second wedge shape of the mating slide fits into the first wedge shape of the mating groove. In some embodiments of the method, forming the main base and the accessory mount includes: machining the main base and the accessory mount from a metal. In some embodiments of the method, the metal is an aluminum alloy. In some embodiments of the method, the aluminum alloy is a tempered aluminum alloy. In some embodiments of the method, assembling the firearm accessory mount further includes: affixing a release pin in a pin hole of the main base. In some embodiments of the method, assembling the firearm accessory mount further includes: securing a detachable rail to the main base. In some embodiments of the method, assembling the firearm accessory mount further includes: securing a backing plate to the main base.

In an embodiment, a method includes: attaching a main base of a firearm accessory mount to a firearm, the main base including a mating groove, a first width of the mating groove decreasing continually in a first direction extending from a front of the main base to a rear of the main base; and attaching an accessory mount to an accessory for the firearm, the accessory mount including a mating slide, a second width of the mating slide decreasing continually in a second direction extending from a front of the accessory mount to a rear of the accessory mount; sliding the mating slide of the accessory mount into the mating groove of the main base; and inserting a release pin in a first pin hole of the mating groove and in a second pin hole of the mating slide.

BRIEF DESCRIPTION OF THE DRAWINGS

For a more complete understanding of the present invention, and the advantages thereof, reference is now made to the following descriptions taken in conjunction with the accompanying drawings, in which:

FIGS. 2A-5B are various views of components of a firearm accessory mount, in accordance with some embodiments;

DETAILED DESCRIPTION OF ILLUSTRATIVE EMBODIMENTS

Figure 1A:
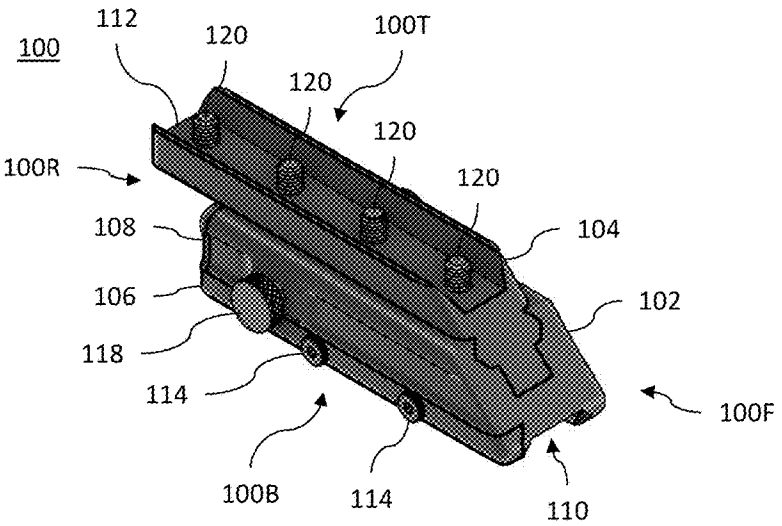
FIGS. 1A-1F are various views of a firearm accessory mount, in accordance with some embodiments.

The following disclosure provides many different embodiments, or examples, for implementing different features of the invention. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

According to various embodiments, a firearm accessory mount includes a lower portion and an upper portion that are detachable from one another. The lower portion includes a main base for attachment to a firearm. The upper portion includes an accessory mount for attachment to an accessory for the firearm. The lower portion and the upper portion each have features that allow the upper portion to be secured in a same position relative the lower portion each time the upper portion is mated to the lower portion. Accordingly, an accessory such as a scope may be re-indexed to the same location of the firearm with high accuracy each time it is attached.

Figure 1B:
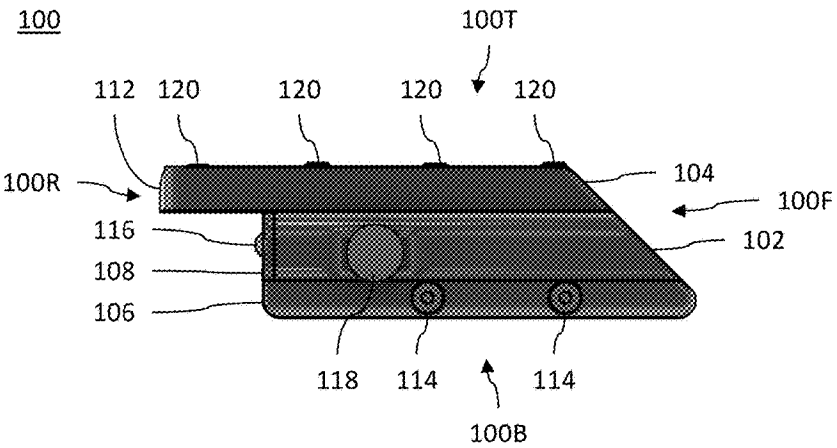
Figure 1C:
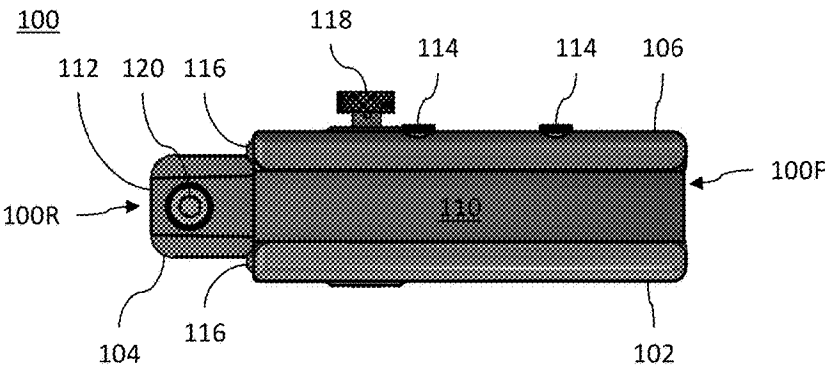
Figure 1D:
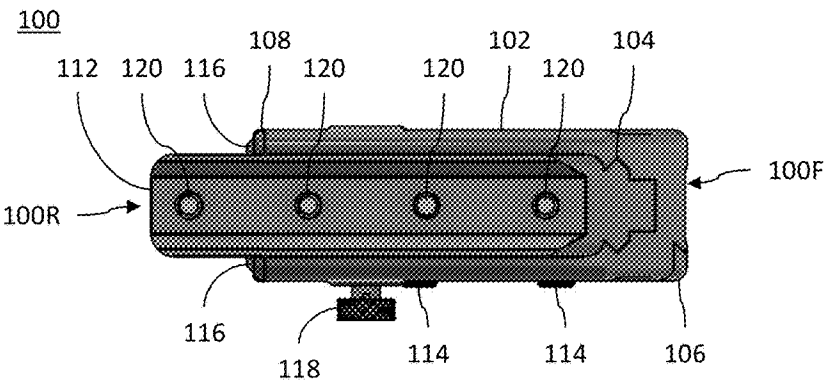
Figure 1F:
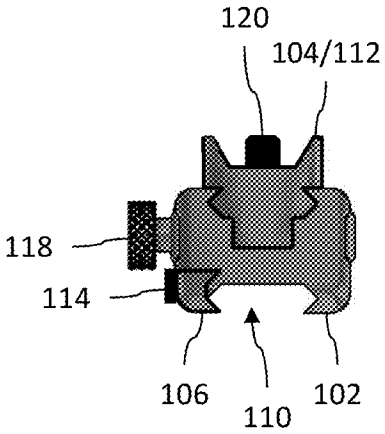
Figure 1E:
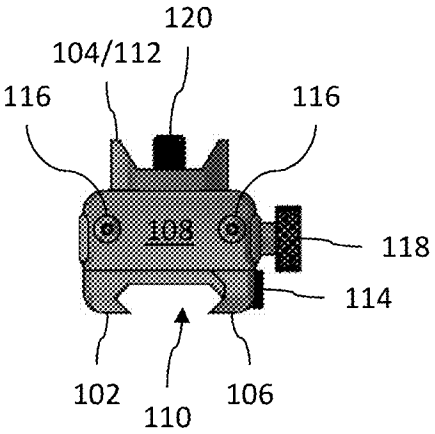

FIGS. 1A-1F are various views of a firearm accessory mount 100, in accordance with some embodiments. FIG. 1A is a perspective view of the firearm accessory mount 100. FIG. 1B is a side view of the firearm accessory mount 100. The firearm accessory mount 100 has a top 100T (e.g., the portion facing upwards in FIGS. 1A-1B) and a bottom 100B (e.g., the portion facing downwards in FIGS. 1A-1B). FIG. 1C is a view of the bottom 100B of the firearm accessory mount 100. FIG. 1D is a view of the top 100T of the firearm accessory mount 100. The firearm accessory mount 100 also has a front 100F (e.g., the portion facing right in FIGS. 1A-1D) and a rear 100R (e.g., the portion facing left in FIGS. 1A-1D). FIG. 1E is a view of the rear 100R of the firearm accessory mount 100. FIG. 1F is a view of the front 100F of the firearm accessory mount 100. FIGS. 1A-1F will be described together. In this context, the front 100F, the rear 100R, the top 100T, and the bottom 100B are relative to the firearm accessory mount 100. The firearm accessory mount 100 may be oriented in any appropriate direction, relative to a firearm or accessory.

The firearm accessory mount 100 includes a main base 102, an accessory mount 104, a detachable rail 106, and a backing plate 108. The main base 102 and the detachable rail 106 collectively define a firearm groove no for attaching the firearm accessory mount 100 to a firearm (not separately illustrated). In some embodiments, the firearm groove 110 is horseshoe-shaped when viewed from the front 100F or the rear 100R, so that the firearm accessory mount 100 may be clamped onto a rail of a firearm (e.g., a picatinny rail). The accessory mount 104 has an accessory groove 112 for attaching an accessory (not separately illustrated) to the firearm accessory mount 100. In some embodiments, the accessory groove 112 is U-shaped when viewed from the front 100F or the rear 100R, so that an accessory may be placed in and attached to the accessory groove 112. It should be appreciated that any shapes may be utilized for the firearm groove 110 and/or the accessory groove 112, depending on the type of firearm rail or accessory.

The accessory mount 104 mates to the main base 102. The accessory mount 104 is a male portion of the firearm accessory mount 100 and the main base 102 is a female portion of the firearm accessory mount 100. The firearm accessory mount 100 is assembled by securing a slide of the accessory mount 104 into a groove of the main base 102. As will be subsequently described in greater detail, the main base 102 and the accessory mount 104 include features that allow the accessory mount 104 to be secured in a same position relative the main base 102 each time the accessory mount 104 is mated to the main base 102. Accordingly, an accessory such as a scope may be detached from the firearm and reattached to the firearm, such that the sighting axis of the scope remains aligned with the bore axis of the firearm each time the scope is reattached to the firearm. The backing plate 108 secures to the main base 102, and protects the groove/slide from dust and grime.

The firearm accessory mount 100 further includes cross bolts 114, backing plate bolts 116, and a release pin 118. The cross bolts 114 are used for securing the detachable rail 106 to the main base 102. The cross bolts 114 and the backing plate bolts 116 may include heads with any desired shape, such as hexagons, stars, or the like. The backing plate bolts 116 are used for securing the backing plate 108 to the main base 102. The release pin 118 is used for securing the accessory mount 104 to the main base 102. The release pin 118 may be a quick-release pin such as an indexing plunger release pin or the like. The firearm accessory mount 100 optionally further include accessory bolts 120 for securing an accessory (not separately illustrated) to the accessory mount 104. The accessory bolts 120 may be omitted or replaced with another type of connector depending on the type of accessory.

Figure 2B:
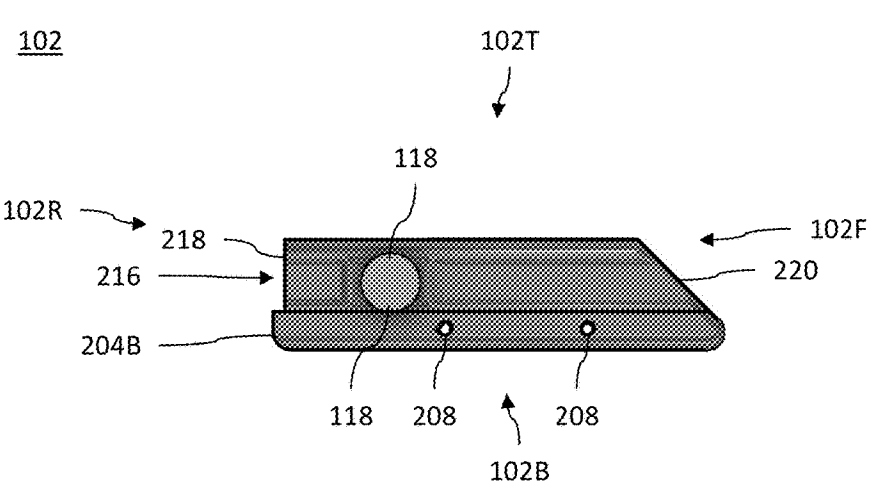
Figure 2A:
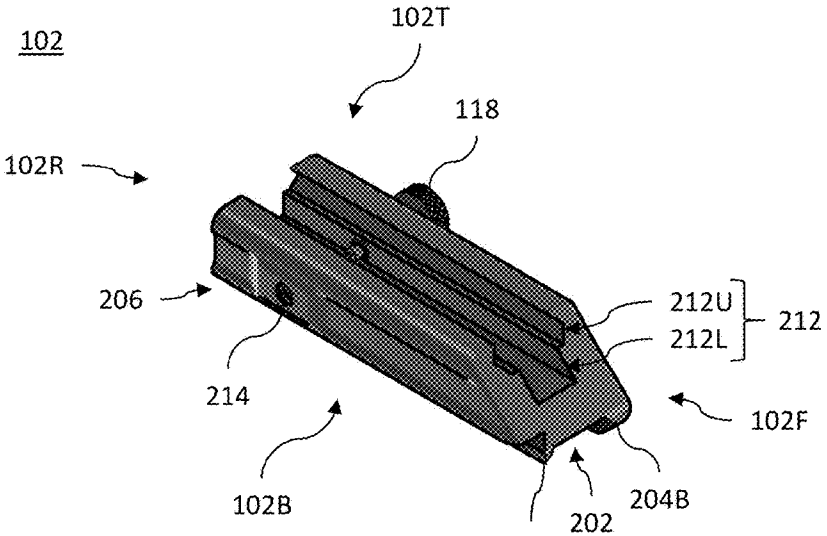
Figure 2D:
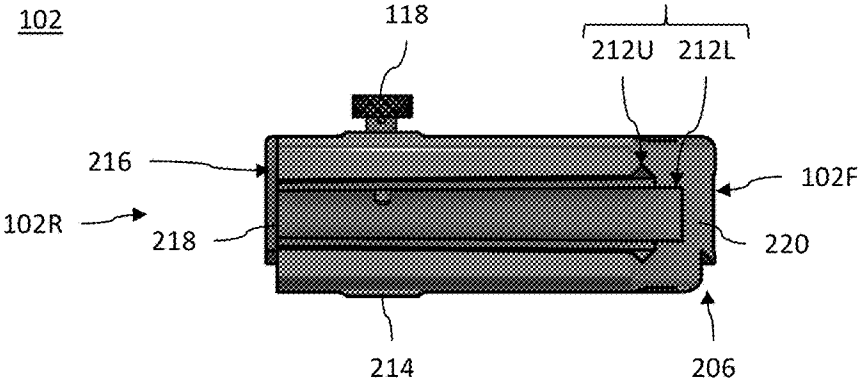
Figure 2C:
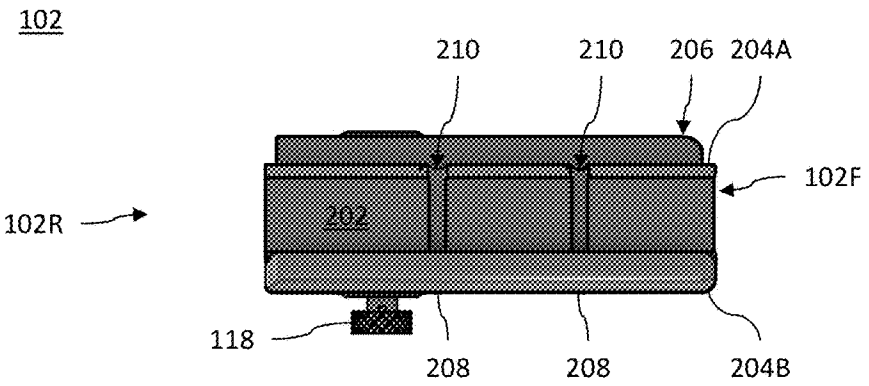

FIGS. 2A-2D are various views of the main base 102, in accordance with some embodiments. FIG. 2A is a perspective view of the main base 102. FIG. 2B is a side view of the main base 102. The main base 102 has a top 102T (e.g., the portion facing upwards in FIGS. 2A and 2B) and a bottom 102B (e.g., the portion facing downwards in FIGS. 2A and 2B). FIG. 2C is a view of the bottom 102B of the main base 102. FIG. 2D is a view of the top 102T of the main base 102. The main base 102 also has a front 102F (e.g., the portion facing right in FIGS. 2A-2D) and a rear 102R (e.g., the portion facing left in FIGS. 2A-2D).

The bottom 102B of the main base 102 includes a firearm groove 202, which defines a portion of the firearm groove 110 of the firearm accessory mount 100 (see FIGS. 1A-1F). The firearm groove 202 is defined by a first downward projection 204A, a second downward projection 204B, and a first bottom surface of the main base 102. The bottom 102B of the main base 102 also includes a rail groove 206 for the detachable rail 106 (see FIGS. 1A-1F) adjacent to the firearm groove 202. The rail groove 206 is defined by the first downward projection 204A and a second bottom surface of the main base 102. The first downward projection 204A may be asymmetric, and is narrower than the second downward projection 204B. The second downward projection 204B includes cross bolt sockets 208 for the cross bolts 114 (see FIGS. 1A-1F). The cross bolt sockets 208 may be threaded sockets for the cross bolts 114 to be screwed into. Additionally, the bottom 102B of the main base 102 includes cross bolt grooves 210 that are perpendicular to and extend across the firearm groove 202. The cross bolt grooves 210 are for accommodating the bolts 114 (see FIGS. 1A-1F) and are aligned with the cross bolt sockets 208. The firearm groove 202, the rail groove 206, and the cross bolt grooves 210 each face downward and away from the main base 102.

The top 102T of the main base 102 includes a mating groove 212 for mating to the accessory mount 104 (see FIGS. 1A-1F). A lower portion 212L of the mating groove 212 has substantially parallel sidewalls. An upper portion 212U of the mating groove 212 has flared sidewalls. The parallel sidewalls of the lower portion 212L are tall enough to accommodate pin hole(s) 214 for the release pin 118 (see FIGS. 1A-1F) in one or both side(s) of the mating groove 212. The upper portion 212U is wider than the lower portion 212L. The flared sidewalls of the upper portion 212U are concave, so that a mating slide 302 of the accessory mount 104 (subsequently described for FIGS. 3A-3D) with convex sidewalls may be secured in the upper portion 212U. The mating groove 212 extends from the front 102F to the rear 102R of the main base 102. As demonstrated in FIG. 2D, the mating groove 212 has a wedge shape, such that a width of the mating groove 212 (including the upper portion 212U and the lower portion 212L) decreases continually in a direction extending from the front 102F of the main base 102 to the rear 102R of the main base 102.

In FIG. 2A, a release pin 118 is affixed in a pin hole 214 that is opposite that in FIGS. 1A-1F. In FIG. 2B, a release pin 118 is affixed in a pin hole 214 that is the same as that in FIGS. 1A-1F. It should be appreciated that a release pin 118 could be disposed at either side of the main base 102, to accommodate left-handed or right-handed operation.

The rear 102R of the main base 102 includes a backing plate recess 216. The backing plate recess 216 is for accommodating the backing plate 108. The backing plate recess 216 does not extend into the first downward projection 204A or the second downward projection 204B. Additionally, the rear 102R of the main base 102 includes flat sidewall 218 in the backing plate recess 216. The flat sidewall 218 forms a right angle with the bottom 102B of the main base 102. The rear 102R of the main base 102 also includes sockets (not separately illustrated) for the backing plate bolts 116 (see FIGS. 1A-1F). The sockets may be threaded sockets for the backing plate bolts 116 to be screwed into.

In some embodiments, the front 102F of the main base 102 includes an angled sidewall 220. The angled sidewall 220 forms an acute angle with the bottom 102B of the main base 102. The acute angle formed by the angled sidewall 220 is less than the right angle formed by the flat sidewall 218. The angled sidewall 220 can help increase assembly ease when securing the accessory mount 104 in the main base 102.

In some embodiments, all or a portion of the mating groove 212 includes a thin liner (not separately illustrated), such as a rubber or plastic liner. The liner may provide a snug fit between the main base 102 and the accessory mount 104. The liner may help absorb shock and vibration that would otherwise travel from the firearm to the access, such as shock from discharge of the firearm.

Figure 3A:
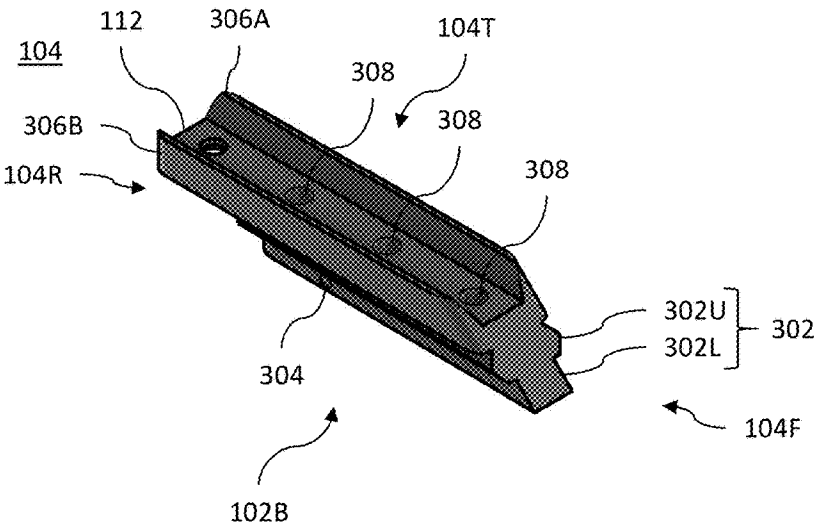
Figure 3B:
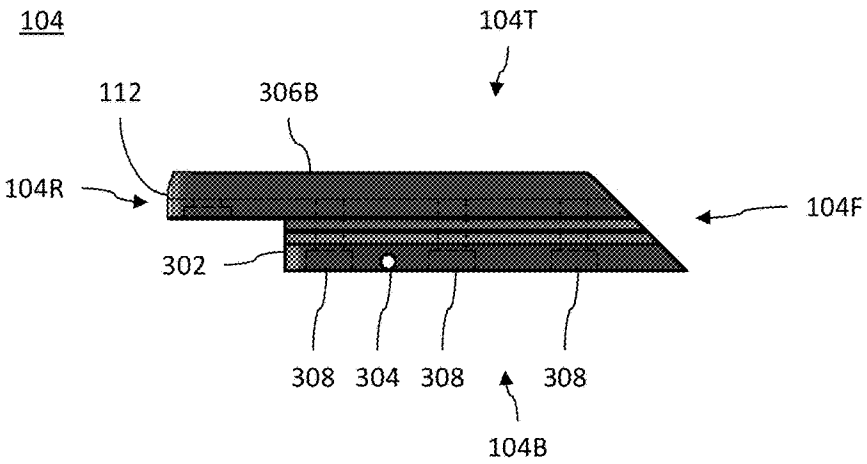
Figure 3C:
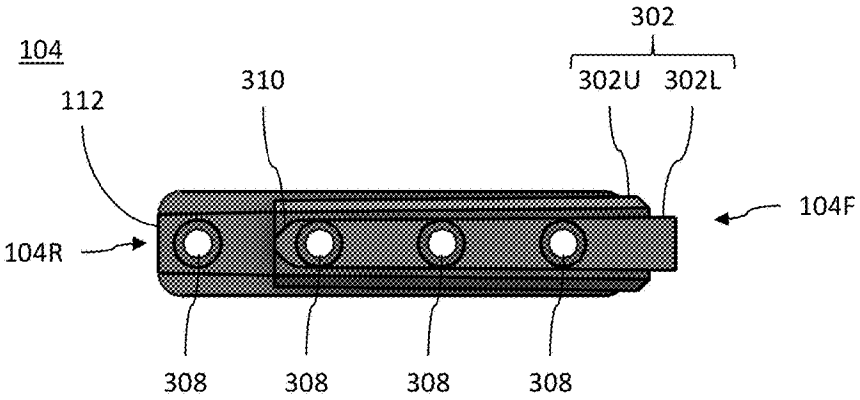
Figure 3D:
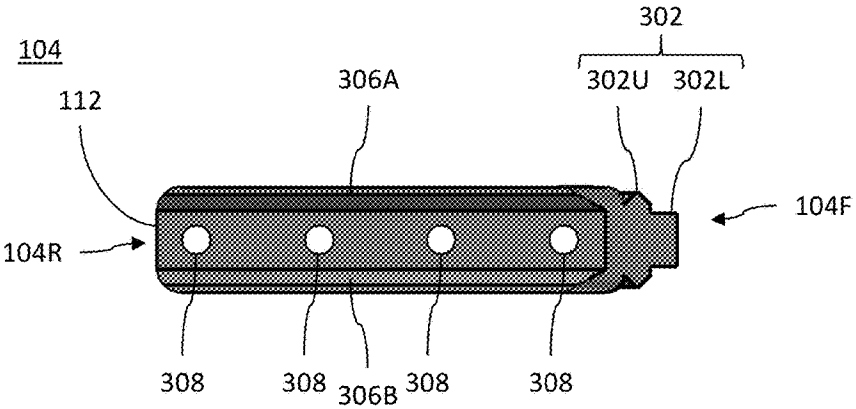

FIGS. 3A-3D are various views of the accessory mount 104, in accordance with some embodiments. FIG. 3A is a perspective view of the accessory mount 104. FIG. 3B is a side view of the accessory mount 104. The accessory mount 104 has a top 104T (e.g., the portion facing upwards in FIGS. 3A and 3B) and a bottom 104B (e.g., the portion facing downwards in FIGS. 3A and 3B). FIG. 3C is a view of the bottom 104B of the accessory mount 104. FIG. 3D is a view of the top 104T of the accessory mount 104. The accessory mount 104 also has a front 104F (e.g., the portion facing right in FIGS. 3A-3D) and a rear 104R (e.g., the portion facing left in FIGS. 3A-3D).

The bottom 104B of the accessory mount 104 includes a mating slide 302 for mating to the main base 102 (see FIGS. 1A-1F). The cross-sectional shape of the mating slide 302 complements the cross-sectional shape of the mating groove 212 (see FIGS. 2A-2D), such that the mating slide 302 fits in the mating groove 212 without space to spare. A lower portion 302L of the mating slide 302 has substantially parallel sidewalls, in the same manner as the lower portion 212L of the mating groove 212. An upper portion 302U of the mating slide 302 has flared sidewalls, in the same manner as the upper portion 212U of the mating groove 212. The parallel sidewalls of the lower portion 302L are tall enough to accommodate a pin hole 304 for the release pin 118 (see FIGS. 1A-1F) in the mating slide 302. The upper portion 302U is wider than the lower portion 302L. The flared sidewalls of the upper portion 302U are convex, so that the mating groove 212 of the main base 102 (see FIGS. 2A-2D) with concave sidewalls may secure to the upper portion 302U. The mating slide 302 extends from the front 104F to the rear 104R of the accessory mount 104. As demonstrated in FIG. 3C, the mating slide 302 has a wedge shape, such that a width of the mating slide 302 (including the upper portion 302U and the lower portion 302L) decreases continually in a direction extending from the front 104F of the accessory mount 104 to the rear 104R of the accessory mount 104.

The top 104T of the accessory mount 104 includes the accessory groove 112. The accessory groove 112 is defined by a first upward projection 306A, a second upward projection 306B, and a first top surface of the accessory mount 104. The first upward projection 306A and the second upward projection 306B are at opposing sides of the accessory mount 104. In some embodiments, the accessory mount 104 includes accessory bolt holes 308 for the accessory bolts 120 (see FIGS. 1A-1F), which are exposed in the accessory groove 112. The accessory bolt holes 308 extend from the top 104T to the bottom 104B of the accessory mount 104, and extend through the mating slide 302. The pin hole 304 in the mating slide 302 may be disposed between two accessory bolt holes 308 in the mating slide 302. The accessory bolt holes 308 include flared recess portions at the bottom 104B of the accessory mount 104.

In some embodiments, the lower portion 302L of the mating slide 302 has a slide taper 310 at the back 104B of the accessory mount 104. The width of the slide taper 310 decreases continually in a direction extending from the front 104F of the accessory mount 104 to the rear 104R of the accessory mount 104. More specifically, the width of the lower portion 302L of the mating slide 302 decreases at a first rate up to a point, and then decreases at a second rate after that point, where the second rate of decrease is greater than the first rate of decrease. The slide taper 310 can help increase assembly ease when securing the accessory mount 104 in the main base 102.

FIGS. 4A-4D are various views of the detachable rail 106, in accordance with some embodiments. FIG. 4A is a perspective view of the detachable rail 106. FIGS. 4B and 4C are side views of the detachable rail 106. The detachable rail 106 has a top 106T (e.g., the portion facing upwards in FIGS. 4A-4C) and a bottom 106B (e.g., the portion facing downwards in FIGS. 4A-4C). The detachable rail 106 also has a front 106F (e.g., the portion facing right in FIGS. 4A-4B and left in FIG. 4C) and a rear 106R (e.g., the portion facing left in FIGS. 4A-4B and right in FIG. 4C). FIG. 4D is a view of the rear 106R of the detachable rail 106.

The top 106T and the bottom 106B of the detachable rail 106 may be flat. The inner side of the detachable rail 106 has a mating groove 402 for mating with the first downward projection 204A (see FIGS. 2A-2D). The detachable rail 106 includes cross bolt holes 404 for the cross bolts 114 (see FIGS. 1A-1F). The cross bolt holes 404 are aligned with the mating groove 402. The cross bolt holes 404 include flared recess portions at the outer side of the accessory mount 104.

Figure 5B:
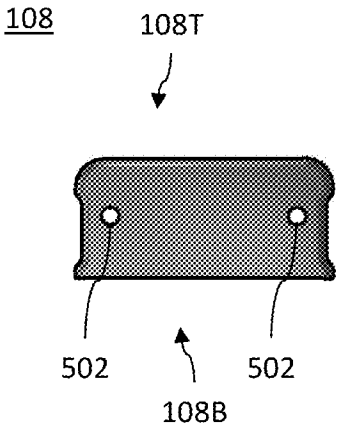
Figure 5A:
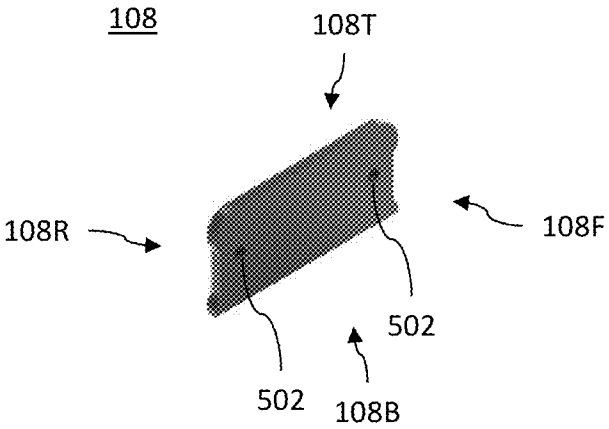

FIGS. 5A-5B are various views of the backing plate 108, in accordance with some embodiments. FIG. 5A is a perspective view of the backing plate 108. The backing plate 108 has a top 108T (e.g., the portion facing upwards in FIGS. 5A and 5B), a bottom 108B (e.g., the portion facing downwards in FIGS. 5A and 5B), a front 108F (e.g., the portion facing right in FIG. 5A) and a rear 108R (e.g., the portion facing left in FIG. 5A). FIG. 5B is a view of the rear 108R of the backing plate 108.

The backing plate 108 includes backing plate bolt holes 502 for the backing plate bolts 116 (see FIGS. 1A-1F). The backing plate bolt holes 502 extend through the backing plate 108. The backing plate bolt holes 502 extend from the front 108F of the backing plate 108 to the rear 108R of the backing plate 108.

Figure 6:
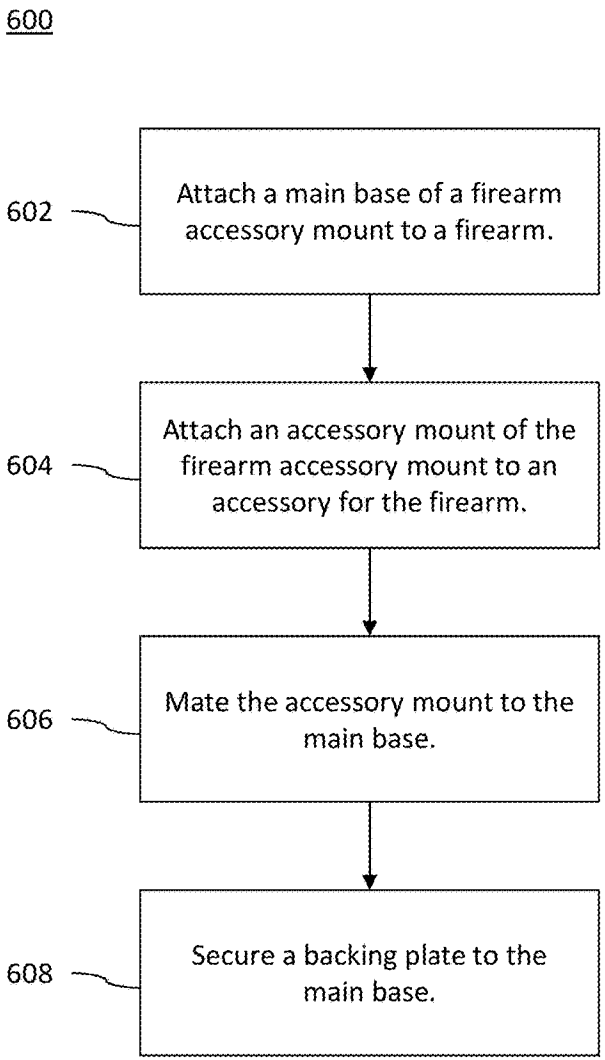
FIG. 6 is a diagram of a method for assembling a firearm accessory mount, in accordance with some embodiments.

FIG. 6 is a diagram of a method 600 for assembling the firearm accessory mount 100, in accordance with some embodiments. The method 600 may be performed to attach an accessory to a firearm. The method 600 is described in conjunction with FIGS. 1A-5B.

In step 602, the main base 102 is attached to a firearm (not separately illustrated). Specifically, the main base 102 and the backing plate 108 are assembled around the rail of the firearm so that the rail is in the firearm groove no. The main base 102 is placed on one side of the rail and the detachable rail 106 is placed on the opposing side of the rail. The detachable rail 106 is disposed in the rail groove 206 of the main base 102. The cross bolts 114 are threaded through the cross bolt holes 404 of the detachable rail 106, disposed in the cross bolt grooves 210 of the main base 102, and then screwed into the cross bolt sockets 208 of the main base 102.

In step 604, the accessory mount 104 is attached to an accessory (not separately illustrated) for the firearm. Specifically, the accessory groove 112 of the accessory mount 104 is attached to the accessory so that the access is in the accessory groove 112. The accessory is placed in the accessory groove 112. The accessory bolts 120 may be threaded through the accessory bolt holes 308 of the accessory mount 104 and then screwed into the bottom of the accessory.

In step 606, the accessory mount 104 is mated to the main base 102. The mating slide 302 of the accessory mount 104 is slid into the mating groove 212 of the main base 102. Specifically, the mating slide 302 is slid towards the rear 102R of the main base 102. As previously noted, the mating groove 212 of the main base 102 and the mating slide 302 of the accessory mount 104 each have a wedge shape. Accordingly, the mating slide 302 is slid into the mating groove 212 until the wedge shape of the mating slide 302 fits into the wedge shape of the mating groove 212. The wedge shapes being fitted blocks the mating slide 302 from sliding any further into the mating groove 212. As a result, the accessory mount 104 is secured in a same position relative the main base 102 each time the accessory mount 104 is mated to the main base 102.

When the accessory mount 104 is secured in the main base 102, the pin hole 304 of the accessory mount 104 is aligned with the pin hole(s) 214 of the main base 102. The release pin 118 is then inserted in a pin hole 214 and the pin hole 304, to prevent the mating slide 302 from sliding back out of the mating groove 212. In some embodiments where the release pin 118 is a quick-release pin, the release pin 118 may be affixed in a pin hole 214 and remain under tension and pressing against the mating slide 302 while the mating slide 302 is being slid into the mating groove 212. The quick-release pin may thus decompress and automatically be inserted into the pin hole 304 when the release pin 118 aligns with the pin hole 304.

In step 608, the backing plate 108 is secured to the main base 102. The backing plate 108 thus covers and protects the back of the mating slide 302 and the mating groove 212. The backing plate 108 is placed in the backing plate recess 216. The backing plate bolts 116 are threaded through the backing plate bolt holes 502 of the backing plate 108 and then screwed into sockets (not separately illustrated) at the rear 102R of the main base 102. The backing plate 108 may be secured to the main base 102 before or after the accessory mount 104 is mated to the main base 102.

Figure 7:
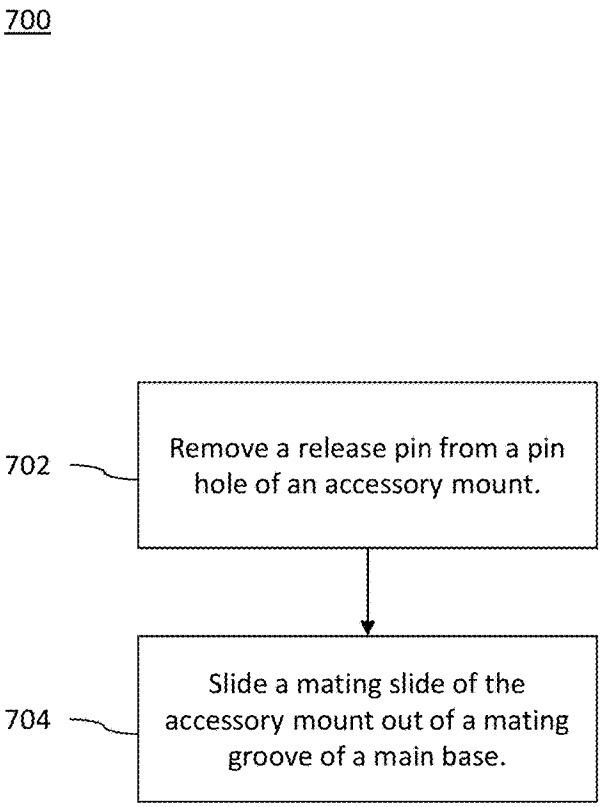
FIG. 7 is a diagram of a method for disassembling a firearm accessory mount, in accordance with some embodiments.

FIG. 7 is a diagram of a method 700 for disassembling the firearm accessory mount 100, in accordance with some embodiments. The method 700 may be performed to detach an accessory from a firearm. The method 700 is described in conjunction with FIGS. 1A-5B.

In step 702, the release pin 118 is removed from the pin hole 304 of the accessory mount 104. In some embodiments where the release pin 118 is a quick-release pin, the release pin 118 may be removed from the pin hole 304 by pulling on the release pin 118. Once the release pin 118 is removed from the pin hole 304, the mating slide 302 is free to slide out of the mating groove 212.

In step 704, the mating slide 302 is slid out of the mating groove 212. Specifically, the mating slide 302 is slid towards the front 102F of the main base 102.

Figure 8:
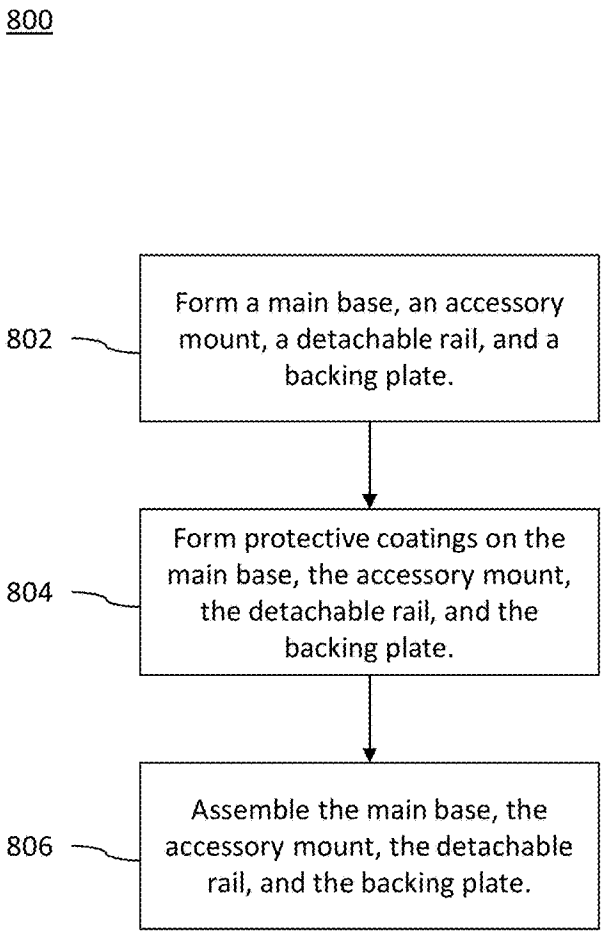
FIG. 8 is a diagram of a method of forming the firearm accessory mount, in accordance with some embodiments.

FIG. 8 is a diagram of a method 800 of forming the firearm accessory mount 100, in accordance with some embodiments. The method 800 is described in conjunction with FIGS. 1A-5B.

In step 802, the main base 102, the accessory mount 104, the detachable rail 106, and the backing plate 108 are formed. The main base 102, the accessory mount 104, the detachable rail 106, and the backing plate 108 may each be formed of a metal such as aluminum, and may be formed by a machining process such as computer numeric control (CNC) machining or the like. In some embodiments, the metal is an aluminum alloy, which comprises from 95.85% to 98.56% aluminum, from 0.80% to 1.20% magnesium, and from 0.40% to 0.80% silicon, such as 6061 Aluminum alloy. The aluminum alloy may be a tempered aluminum alloy, such as 6061-T6 Aluminum alloy. The main base 102, the accessory mount 104, the detachable rail 106, and the backing plate 108 may each be a separate continuous feature of the metal.

Other acceptable techniques and materials may be utilized for the main base 102, the accessory mount 104, the detachable rail 106, and the backing plate 108. For example, the main base 102, the accessory mount 104, the detachable rail 106, and the backing plate 108 may be formed by stamping or the like. Additionally, the main base 102, the accessory mount 104, the detachable rail 106, and the backing plate 108 may be formed of a plastic or composite material, and may be formed by molding or the like.

In step 804, protective coatings (not separately illustrated) are optionally formed on the main base 102, the accessory mount 104, the detachable rail 106, and the backing plate 108. The protective coatings may be, e.g., oxide coatings formed by adonization. In some embodiments, the adonizing is by Type II or Type III anodizing. The adonization may be omitted if the main base 102, the accessory mount 104, the detachable rail 106, and the backing plate 108 are formed of a material that does not require adonization.

In step 806, the main base 102, the accessory mount 104, the detachable rail 106, and the backing plate 108 are assembled. The main base 102, the accessory mount 104, the detachable rail 106, and the backing plate 108 may be assembled utilizing the previously described method 600.

Embodiments may achieve advantages. Because the mating groove 212 and the mating slide 302 each have a wedge shape, the mating slide 302 may be slide into the mating groove 212 until the wedge shape of the mating slide 302 fits into the wedge shape of the mating groove 212, but may not be slid any further into the mating groove 212. As a result, the accessory mount 104 may be secured in a same position relative the main base 102 each time the accessory mount 104 is mated to the main base 102. When the firearm accessory mount 100 is used to attach a scope to a firearm, the scope may thus be secured in a same position relative the firearm each time the accessory mount 104 is mated to the main base 102. A previously configured sighting axis of the scope may thus remain aligned with the bore axis of the firearm. The scope may thus be detached from the firearm for safe storage or for independent use (e.g., as a monocular) and then reattached to the firearm, without needing to be re-sighted each time it is attached to the firearm. Additionally, multiple scopes may be attached to respective accessory mounts 104, and different scopes may be easily swapped in and out for use with a same firearm, without needing to re-sight the scopes.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A firearm accessory mount comprising:
- a main base comprising:
  - a firearm groove at a bottom of the main base; and
  - a mating groove at a top of the main base, the mating groove extending from a front of the main base to a rear of the main base, a first width of the mating groove decreasing continually in a first direction extending from the front of the main base to the rear of the main base;
- an accessory mount comprising:
  - an accessory groove at a top of the accessory mount; and
  - a mating slide at a bottom of the accessory mount, the mating slide extending from a front of the accessory mount to a rear of the accessory mount, a second width of the mating slide decreasing continually in a second direction extending from the front of the accessory mount to the rear of the accessory mount;
- a backing plate, wherein the main base further comprises a backing plate recess for the backing plate at the rear of the main base; and
- backing plate bolts securing the backing plate to the main base.

2. The firearm accessory mount of claim 1, wherein the main base further comprises a first pin hole, the accessory mount further comprises a second pin hole, and the first pin hole is aligned with the second pin hole when the mating slide is fitted in the mating groove.

3. The firearm accessory mount of claim 2 further comprising:
- a release pin in the first pin hole.

4. The firearm accessory mount of claim 1, wherein the accessory mount further comprises accessory bolt holes extend from the top of the accessory mount to the bottom of the accessory mount.

5. The firearm accessory mount of claim 1, wherein a lower portion of the mating groove has straight sidewalls and an upper portion of the mating groove has flared sidewalls.

6. The firearm accessory mount of claim 1, wherein an upper portion of the mating groove is wider than a lower portion of the mating groove.

7. The firearm accessory mount of claim 1, wherein a lower portion of the mating slide has straight sidewalls and an upper portion of the mating slide has flared sidewalls.

8. The firearm accessory mount of claim 1, wherein an upper portion of the mating slide is wider than a lower portion of the mating slide.

9. The firearm accessory mount of claim 1 further comprising:
- a detachable rail, wherein the main base further comprises a rail groove for the detachable rail at the bottom of the main base.

10. The firearm accessory mount of claim 9 further comprising:
- cross bolts securing the detachable rail to the main base.

11. The firearm accessory mount of claim 1 further comprising:
- a release pin, wherein the main base further comprises a first pin hole, wherein the release pin is in the first pin hole.

12. The firearm accessory mount of claim 11, wherein the release pin is an indexing plunger release pin.

13. The firearm accessory mount of claim 1, wherein the main base and the accessory mount comprise a metal.

14. The firearm accessory mount of claim 13, wherein the metal is an aluminum alloy.

15. The firearm accessory mount of claim 1, wherein the front of the main base has an angled sidewall.

16. The firearm accessory mount of claim 1 further comprising:
- protective coatings on the main base and the accessory mount.

17. The firearm accessory mount of claim 1, wherein the backing plate comprises holes for the backing plate bolts, and the main base further comprises sockets for the backing plate bolts at the rear of the main base.

18. A firearm accessory mount comprising:
- a main base comprising:
  - a firearm groove at a bottom of the main base; and
  - a mating groove at a top of the main base, the mating groove extending from a front of the main base to a rear of the main base, a first width of the mating groove decreasing continually in a first direction extending from the front of the main base to the rear of the main base;
- an accessory mount comprising:
  - an accessory groove at a top of the accessory mount; and
  - a mating slide at a bottom of the accessory mount, the mating slide extending from a front of the accessory mount to a rear of the accessory mount, a second width of the mating slide decreasing continually in a second direction extending from the front of the accessory mount to the rear of the accessory mount; and a backing plate comprising backing plate bolt holes, wherein the main base further comprises a backing plate recess for the backing plate at the rear of the main base.

19. The firearm accessory mount of claim 18 further comprising:

a detachable rail, wherein the main base further comprises a rail groove for the detachable rail at the bottom of the main base.

20. The firearm accessory mount of claim 18 further comprising:

a release pin, wherein the main base further comprises a first pin hole, wherein the release pin is in the first pin hole.

* * * * *